United States Patent [19]

Yoshihara

[11] Patent Number: 4,881,081

[45] Date of Patent: Nov. 14, 1989

[54] ANTENNA ORIENTATION ADJUSTING DEVICE FOR EARTH STATION

[75] Inventor: Masashi Yoshihara, Tokyo, Japan

[73] Assignee: NEC Corporation, Japan

[21] Appl. No.: 313,291

[22] Filed: Feb. 17, 1989

Related U.S. Application Data

[63] Continuation of Ser. No. 97,661, Sep. 15, 1987, abandoned.

[30] Foreign Application Priority Data

Sep. 17, 1986 [JP] Japan ..... 61-218855

[51] Int. Cl.[4] ..... H01Q 3/00

[52] U.S. Cl. ..... 342/359

[58] Field of Search ..... 342/359, 356; 455/25; 343/703, 882

[56] References Cited

U.S. PATENT DOCUMENTS 2,553,295 5/1951 Bock ..... 343/882
3,728,633 4/1973 Krebs .
4,014,020 3/1977 Barrett, Jr. et al. .
4,210,911 7/1980 Jacomini .
4,696,053 9/1987 Mastriani et al. ..... 455/67
4,796,032 1/1989 Sakurai et al. ..... 342/359

*Primary Examiner*—Theodore M. Blum
*Attorney, Agent, or Firm*—Ostrolenk, Faber, Gerb & Soffen

[57] ABSTRACT

A device for adjusting the orientation of an antenna for an earth station. A received signal from the antenna is delivered from an outdoor unit to a demodulator of an indoor unit to be demodulated thereby. In the indoor unit, a converter receives an automatic gain controlled voltage signal from the demodulator and converts it into a digital signal, and a controller converts the digital signal into a predetermined control signal to feed it to the outdoor unit over the cable. In the outdoor unit, a display responsive to the control signal indicates a particular level which corresponds to the automatic gain controlled voltage. A person, therefore, can adjust the antenna to an optimum orientation unassisted, i.e., while observing the display.

6 Claims, 3 Drawing Sheets

ANTENNA ORIENTATION ADJUSTING DEVICE FOR EARTH STATION

This is a continuation of application Ser. No. 097,661, filed on Sept. 15, 1987, now abandoned.

BACKGROUND OF THE INVENTION

The present invention relates to a device for adjusting the orientation of an antenna which is installed in an earth station.

In parallel with the progress of satellite communications, miniature and inexpensive earth stations have come to be extensively used. This kind of earth station generally constitutes an indoor unit connected to a terrestrial line or terminal, an antenna whose orientation is manually adjustable, an outdoor unit located in the vicinity of the antenna, and a cable for interconnecting the indoor and outdoor units. The indoor unit is provided with a demodulator. A spectrum analyzer is connected to the demodulator. In such a prior art earth station, the orientation of the antenna is adjustable by hand. Specifically, the level of a received signal coming in through the antenna and fed to the demodulator of the indoor unit via the outdoor unit and cable is confirmed by using the spectrum analyzer. However, a problem with this kind of scheme is that the adjustment cannot be accomplished without resorting to two persons, i.e., one for manually changing the orientation of the outdoor antenna and the other for monitoring the level of a received signal which appears on the spectrum analyzer.

SUMMARY OF THE INVENTION

It is, therefore, an object of the present invention to provide a device which allows a single person to adjust to an optimum value the orientation of an antenna of an earth station.

It is another object of the present invention to provide a generally improved antenna orientation adjusting device for an earth station.

In accordance with the present invention, there is provided a device for adjusting the orientation of an antenna for an earth station the device comprising a manually-oriented antenna reflecting surface an outdoor unit located in the vicinity of an antenna, and an indoor unit connected to the outdoor unit by a cable and including a demodulator for demodulating a received signal, which the outdoor unit delivers to the cable, while applying automatic gain control to the received signal. The device further comprises a converting means for converting an automatic gain controlled voltage signal supplier by the demodulator into a first signal, a control means for converting the first signal into a predetermined control signal and for feeding the predetermined control signal to the outdoor unit over the cable, and a display means responsive to the control signal for displaying a level which corresponds to the automatic gain controlled voltage.

The above and other objects, features and advantages of the present invention will become more apparent from the following detailed description taken with the accompanying drawings.

DESCRIPTION OF THE PREFERRED EMBODIMENTS

Figure 1:
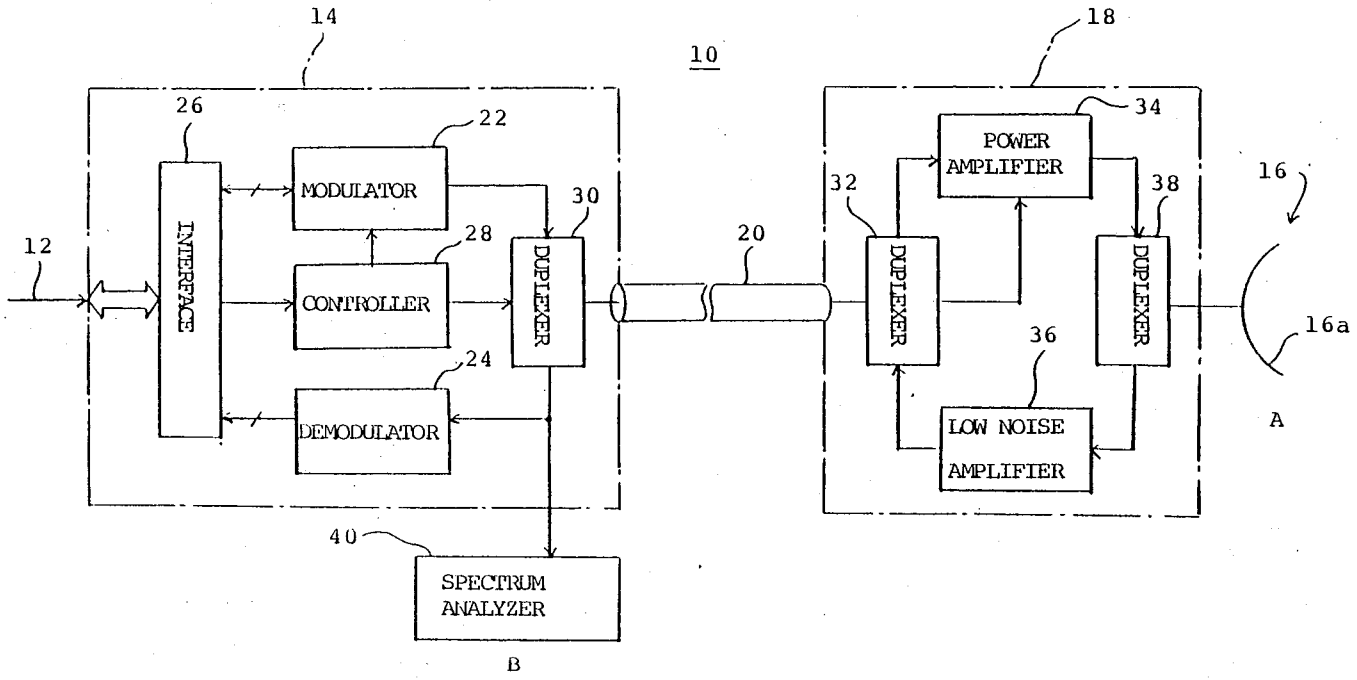
FIG. 1 PRIOR ART
FIG. 1 is a schematic block diagram showing an earth station in which a prior art device for adjusting antenna orientation is installed.

To better understand the present invention, brief reference will first be made to a prior art antenna orientation adjusting device for an earth station, shown in FIG. 1. As shown, a prior art miniature earth station 10 is made up of an indoor unit 14 connected to a ground or terrestial circuit 12, an antenna 16 having a reflecting surface **16*a* the orientation of which is manually changeable, and an outdoor unit 18 located in the vicinity of the antenna 16 and connected to the indoor unit 14 by a cable 20. Basically, the indoor unit 14 comprises a modulator 22, a demodulator 24, an interface 26, a controller 28, and a duplexer 30. On the other hand, the outdoor unit 18 basically comprises a duplexer 32, a power amplifier 34, a low noise amplifier 36, and a duplexer 38**.

The general operation of the earth station 10 will be outlined first. A data signal propagated through the terrestrial circuit 12 is applied to the modulator 22 via the interface 26. The output of the modulator 22 which has undergone predetermined modulation is routed to the antenna 16 as a transmit signal via the duplexer 30, cable 20, duplexer 32, power amplifier 34, and duplexer 38. The major role assigned to the controller 28 is causing the modulator 22 to continue its operation for a predetermined period of time so that the transmit signal may become a burst signal, and feeding a transmit timing control signal to the power amplifier 34. A received signal coming in through the antenna 16 is fed to the terrestrial circuit 12 via the duplexer 28, low noise amplifier 36, duplexer 32, cable 20, duplexer 30, demodulator 24, and interface 26. It is to be noted that the demodulator 24 is provided with an automatic gain controller.

In the prior art earth station 10, the adjustment of orientation of the antenna 16 is implemented with a spectrum analyzer 40, as shown in FIG. 1. Specifically, the orientation of the antenna 16 is adjusted while checking the level of an input signal to the demodulator 24, i.e., a receive level which appears on the spectrum analyzer 40.

Generally, the indoor unit 14 and the outdoor unit 18, i.e., the spectrum analyzer 40 and the antenna 16 are located at considerably remote places from each other. Hence, to adjust the orientation of the antenna 16, a person A for manually changing the orientation of the antenna 16 attends at the outdoor unit 18 while, at the same time, a person B for monitoring the receive level on the spectrum analyzer 40 attends at the indoor unit 14. The person B communicates with the person A by use of an intercom or the like so as to move the antenna 16 to an optimum orientation or to inform the person A of the optimum orientation of the antenna 16. Stated another way, the prior art antenna orientation adjustment cannot be practiced without the need for two persons.

Figure 2:
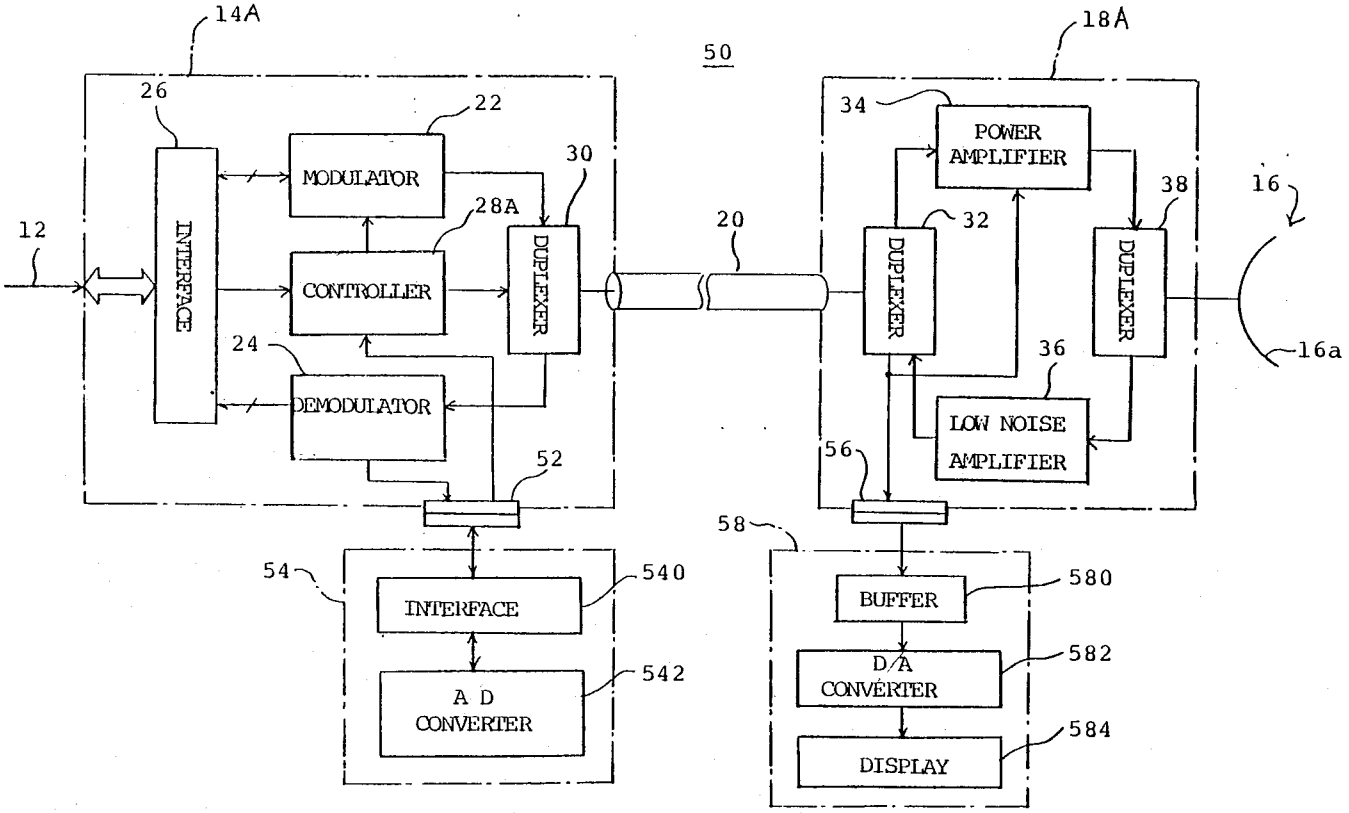
FIG. 2 is a schematic block diagram of an earth station which is provided with an antenna orientation adjusting device embodying the present invention.

Referring to FIG. 2, an earth station in which an antenna orientation adjusting device in accordance with the present invention is installed is shown and generally designated by the reference numeral 50. In FIG. 2, the same or similar structural elements as shown in FIG. 1 are designated by like reference numerals, and detailed description thereof will be omitted. As shown in FIG. 2, in this particular embodiment, a transmitter 54 is detachably mounted on an indoor unit 14A through a connector 52. Likewise, a receiver 58 is detachably connected to the outdoor unit 18A through a connector 56.

In detail, the transmitter 54 basically comprises an interface 540 and an analog-to-digital (AD) converter 542 which serves as a conversion means. The transmitter 54 is connected to a demodulator 24 by the connector 52. Because the demodulator 24 includes an automatic gain controller as stated earlier, an automatic gain controlled voltage signal is digitized by the AD converter 542 via the interface 540 and, then, fed to a controller 28A via the connector 52.

Figure 3:
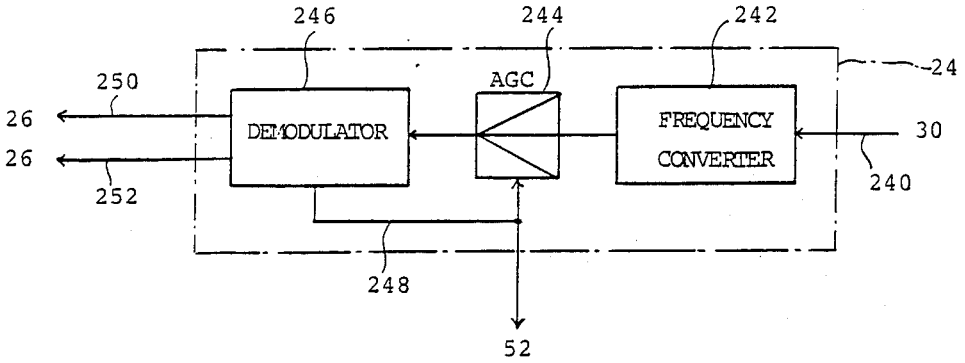
FIG. 3 is a schematic block diagram showing in detail a demodulator as shown in FIG. 2.

FIG. 3 shows a specific construction of the demodulator 24. As shown, a received signal 240 output by a duplexer 30 is converted by a frequency converter 242 to have a desired frequency and, then, applied to a demodulator 246 via an automatic gain controller (AGC) 244. An automatic gain controlled (AGC) voltage signal 248 is fed from the demodulator 246 to the AGC 244 and, at the same time, to the connector 52. The outputs 250 and 252 of the demodulator 24 are routed to an interface 26.

In this embodiment, the controller 28A (FIG. 2) performs predetermined operations as a control means and various kinds of control which are derived from the use of the connector 52, not to speak of the delivery of a transmit timing control signal to a power amplifier 34 and others as have been stated in relation to the controller 28. Specifically, the controller 28A receives a digital signal from the transmitter 54 and converts it into the previously-mentioned control signal which is then routed to a duplexer 38 of the outdoor unit 18A via a duplexer 30 and a cable 20. Because this control signal is identical in format as that which is under transmit control, it is fed to the power amplifier 34 and the receiver 58 in parallel. Upon detecting that the transmitter 54 has been connected to the indoor unit 14A, the controller 28A prevents power from being radiated through an antenna 16 during adjustment of the antenna 16, even if the power amplifier 34 responds to the control signal by performing a usual burst signal transmitting operation. For this purpose, the controller 28A may be constructed to neglect a data signal input from the interface 26 deciding that it has been derived from erroneous operations and the like, or to inhibit the delivery of an output of the demodulator 24, during the adjustment of the antenna 16. Further, the controller 28A performs various kinds of control which are necessary when the connector 52 is loaded, i.e., at the time of antenna adjustment.

Figure 4:
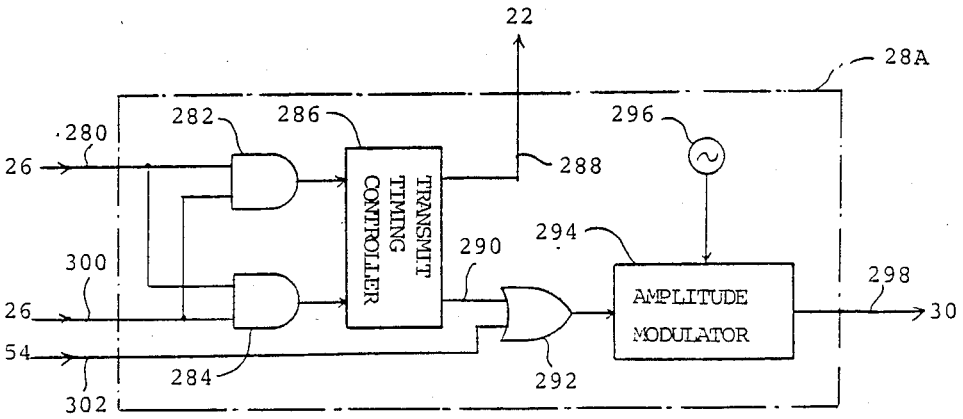
FIG. 4 is a schematic block diagram showing a controller as also shown in FIG. 2.

Referring to FIG. 4, a specific construction of the controller 28A is shown. As shown in the figure, a burst control signal 280 from the interface 26 is applied to AND gates 282 and 284 the outputs of which are coupled to a transmit timing controller 286. The transmit timing controller 286 delivers a control signal 288 to the modulator 22 and a control signal 290 to an OR gate 292. The output of the OR gate 292 is applied to an amplitude modulator 294. Also applied to the amplitude modulator 294 is an output signal of an oscillator 296. The amplitude modulator 294 in turn produces an amplitude modulated signal 298. Specifically, the output 298 of the amplitude modulator 294 appears when the output of the OR gate 292 is a BURST ON signal and does not appear when the latter is a BURST OFF signal. Further, under a usual operating condition, a burst control inhibit signal 300 which is fed from the interface 26 is high level while, at the same time, a digital signal 302 from the transmitter 54 is low level. When the transmitter 54 is mounted to the indoor unit 14, the burst control inhibit signal 300 assumes low level to inhibit the burst control signal 280 resulting that the control signals 280 and 290 become BURST OFF. Under this condition, as the digital signal 302 is applied from the transmitter 54, the output of the OR gate 292 becomes equivalent to an ordinary burst control signal and, also, the output of the amplitude modulator 294 becomes an amplitude modulated signal.

Referring to FIG. 2 again, the receiver 58 basically comprises a buffer 580, a digital-to-analog (DA) converter 582, and a display 584. Because a digital signal included in the previously mentioned control signal is bit serial, the buffer 580 serves as a serial-to-parallel converter for converting the bit serial signal to a bit parallel signal. This bit parallel signal is held in the buffer 580 for a predetermined period of time. The bit-parallel digital signal is turned by the DA converter 582 into an analog signal so that the value of the original AGC voltage signal is applied to the display 584. In response, the display 584 shows a receive level corresponding to the value of the input AGC signal by, for example, the oscillation of a pointer. Hence, a person without the help of others can change the orientation of the antenna 16 until the receive level appearing on the display 584 becomes maximum.

In summary, it will be seen that the present invention provides an antenna orientation adjusting device for an earth station which realizes unassisted adjustment of antenna orientation by a person. Specifically, paying attention to the fact that a demodulator of an indoor unit performs automatic gain control, the device of the present invention allows a person to see the varying value of AGC voltage of an outdoor unit and, therefore, to monitor the receive level while changing the orientation of the antenna.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A device comprising means for permitting a person in the vicinity of a common transmission-and-reception antenna to manually adjust the orientation of a reflecting surface of the antenna, where said antenna is included within an earth station that further includes indoor and outdoor units connected together solely by a solitary signal link used for both transmission and reception; said outdoor unit being located in the vicinity of said antenna; and said indoor unit having a demodulator for demodulating a signal that is received by said antenna and routed to said indoor unit through said solitary signal link and for applying automatic gain control to the received signal; said device further comprising;

a converting means for converting an automatic gain controlled voltage signal output by said demodulator into a first signal;

a control means for converting the first signal into a predetermined control signal and feeding the predetermined control signal to said outdoor unit through said solitary signal link;

a display means electrically connected to the outdoor unit for viewing by the mentioned person and being responsive to the control signal for displaying a level which corresponds to the automatic gain controlled voltage; and disable means for preventing power from being radiated through said antenna when said control and display means are operating.

2. A device as claimed in claim 1, further comprising a first connector for detachably connecting said converting means to said indoor unit, and a second connector for detachably connecting said display means to said outdoor unit.

3. A device as claimed in claim 1, wherein said first signal is a digital signal.

4. A device as claimed in claim 3, wherein said converting means comprises an interface connected to said demodulator, and an analog-to-digital converter connected to said interface.

5. A device as claimed in claim 3, wherein said display means comprises a buffer connected to said outdoor unit, a digital-to-analog converter connected to said buffer, and a display connected to said digital-to-analog converter.

6. A device as claimed in claim 1, wherein said solitary signal link comprises a duplexer-to-cable-to duplexer arrangement.

* * * * *